US012735974B2

(12) United States Patent
Su et al.

(10) Patent No.: US 12,735,974 B2
(45) Date of Patent: Sep. 15, 2026

(54) DYNAMIC LOAD RESISTANT DRILLING SYSTEM

(71) Applicant: Schlumberger Technology Corporation, Sugar Land, TX (US)

(72) Inventors: Tianxiang Su, Arlington, MA (US); Muhannad Abuhaikal, Cambridge, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/291,942

(22) Filed: Aug. 6, 2025

(65) Prior Publication Data

US 2026/0043325 A1 Feb. 12, 2026

Related U.S. Application Data

(60) Provisional application No. 63/681,351, filed on Aug. 9, 2024.

(51) Int. Cl.

| | |
|---|---|
| ***E21B 44/02*** | (2006.01) |
| ***E21B 44/00*** | (2006.01) |
| ***E21B 47/007*** | (2012.01) |
| ***E21B 47/013*** | (2012.01) |
| ***E21B 47/12*** | (2012.01) |

(52) U.S. Cl.

CPC ..... *E21B 44/02* (2013.01); *E21B 44/00* (2013.01); *E21B 47/007* (2020.05); *E21B 47/013* (2020.05); *E21B 47/138* (2020.05)

(58) Field of Classification Search

CPC ..... E21B 44/02; E21B 47/013; E21B 47/138; E21B 44/00; E21B 47/007

See application file for complete search history.

(56) References Cited

U.S. PATENT DOCUMENTS 12,065,922 B2 * 8/2024 Hohl ..... E21B 44/00
2003/0075361 A1 4/2003 Terry
(Continued)

OTHER PUBLICATIONS

Wu, S. X. et al., "Decoupling Stick-slip and Whirl to Achieve Breakthrough in Drilling Performance", IADC/SPE Drilling Conference and Exhibition, IADC/SPE 128767, Feb. 2, 2010, pp. 1-13.
(Continued)

*Primary Examiner* — Daniel P Stephenson
(74) *Attorney, Agent, or Firm* — Jeffrey D. Frantz

(57) ABSTRACT

A drilling system and techniques for managing dynamic load during drilling operations. The system includes a drilling device prone to propagate a dynamic load such as vibration and/or shock during drilling and electronics that may be susceptible to such dynamic loads. Thus, a control unit is provided that is configured for communications with both the electronics and with equipment directing the drilling operations. The unit also accommodates processing for directing the operations in terms of adjustment to drilling device rpm and/or weight on bit as applied to the device depending on monitoring of the dynamic load and in light of certain dynamic thresholds. Thus, real-time operational adjustments may be made to avoid dynamic load damage to electronics while maintaining efficient drilling operations.

20 Claims, 6 Drawing Sheets

(56) References Cited

U.S. PATENT DOCUMENTS

| | | | | |
|---|---|---|---|---|
| 2015/0130627 | A1* | 5/2015 | Morrison | E21B 47/13 340/854.4 |
| 2019/0226333 | A1* | 7/2019 | Vempati | E21B 41/00 |
| 2022/0034214 | A1* | 2/2022 | Kazemi Miraki | E21B 47/007 |
| 2023/0193740 | A1 | 6/2023 | Hohl | |
| 2024/0229632 | A1* | 7/2024 | Samuel | E21B 44/00 |
| 2026/0043325 | A1* | 2/2026 | Su | E21B 44/02 |

OTHER PUBLICATIONS

Christian, E. D., "Identifying the Optimum Zone for Reducing Drill String Vibrations", SPE Annual Technical Conference and Exhibition, SPE-189284-STU, Oct. 9, 2017, pp. 1-12.

Dunlop, J. et al. "Increased Rate of Penetration Through Automation", SPE/IADC Drilling Conference and Exhibition, SPE-139897-MS, Mar. 1, 2011, pp. 1-11.

Nguyen, K. L. et al., "Campbell diagram computation for a drillstring immersed in curved wells", Journal of Vibration and Acoustics, Aug. 2019, pp. 1-11, vol. 141, Issue 4.

* cited by examiner

DYNAMIC LOAD RESISTANT DRILLING SYSTEM

PRIORITY CLAIM/CROSS REFERENCE TO RELATED APPLICATION(S)

This Patent Document claims priority under 35 U.S.C. § 120 to U.S. App. Ser. No. 63/681,351, entitled "METHODS TO MITIGATE DOWNHOLE SHOCK AND VIBRATION FOR COILED TUBING DRILLING (CTD)", filed on Aug. 9, 2024 and incorporated herein by reference in its entirety.

BACKGROUND

Exploring, drilling and completing hydrocarbon and other wells are generally complicated, time consuming and ultimately very expensive endeavors. In recognition of these expenses, equipment and maintenance costs for applications such as drilling are understandably of notable importance. One such concern during drilling of a wellbore, for example, is the amount of dynamic load that results on a drillstring during the application. That is, regular vibration and shock are to be expected during any drilling application. However, certain components of a drillstring are of increased vulnerability when experiencing these types of dynamic loads. The bottom hole assembly, for example, may consist of an electronics package with sensors and other more sensitive parts in addition to a motor, drive and other components.

In light of the fact that the electronics package is more susceptible to damage from dynamic loads, a predetermined level of load may be set and monitored over the course of a drilling application. So, for example, where forces of 15G are detected for a period of time exceeding 10 minutes, an alarm may be sent to an operator at an oilfield surface. The operator may then be alerted to reduce the rpm of the drill bit or to reduce the load on the conveyance, often referenced as reducing the weight on the bit (WOB). That is, as a practical matter, the operator may only exert control over rpm and WOB to reduce vibration or shock during a drilling application. Other factors such as downhole formation characteristics are outside of the operator's control.

Unfortunately, an operator waiting for an alarm at an oilfield surface requires manual adjustment to the drilling operation and is largely guesswork. That is, even assuming that the proper threshold of 15G's for 10 minutes should trigger the alarm, this still requires the operator to decide between rpm reduction, WOB reduction, or both and in what amounts. Of course, this may largely be determined by predetermined guidelines established in advance of drilling operations. However, the predetermined guidelines themselves are also largely established as a matter of guesswork. At present, no automated system is available for making rpm and WOB automatic adjustments during drilling operations. Further, the predetermined guidelines are also not dynamically adjustable over the course of drilling operations so as to better determine potentially moving thresholds that might better avoid more sensitive component damage from shock and vibration.

SUMMARY

A dynamic load resistant drilling system is disclosed for positioning at an oilfield. The system includes a tubular conveyance for accommodating a drilling device. The drilling device is prone to propagate a dynamic load during drilling of a wellbore. Further, an electronics package assembly is also coupled to the tubular conveyance and potentially susceptible to such loads. Therefore, the system further includes a control unit at the oilfield that is in communication with the electronics package assembly and surface equipment directing the drilling. The control unit may further be employed for autonomously and dynamically adjusting either load on the conveyance and/or rpm of the drilling device in real-time based on the dynamic load information.

DETAILED DESCRIPTION

In the following description, numerous details are set forth to provide an understanding of the present disclosure. This includes description of the surrounding environment in which embodiments detailed herein may be utilized. Additionally, it will be understood by those skilled in the art that the embodiments described may be practiced without these and other particular de. Further, numerous variations or modifications may be employed which remain contemplated by the embodiments as specifically described.

Embodiments are described with reference to certain tools and applications run in a wellbore over a conveyance with a drilling device as directed by a drilling system. The embodiments are described with reference to a land-based oilfield with a vertical wellbore being formed by coiled tubing drilling operations. However, this is only exemplary. Embodiments may include an oilfield at sea, and/or be applied to horizontal or multilateral wellbores. Drilling may even be achieved by way of jointed pipe or other more traditional means. So long as the system includes a control unit for autonomously and dynamically adjusting either load on the conveyance and/or rpm of the drilling device in real-time based on the dynamic load information, appreciable benefit to be realized as a result.

Figure 1:
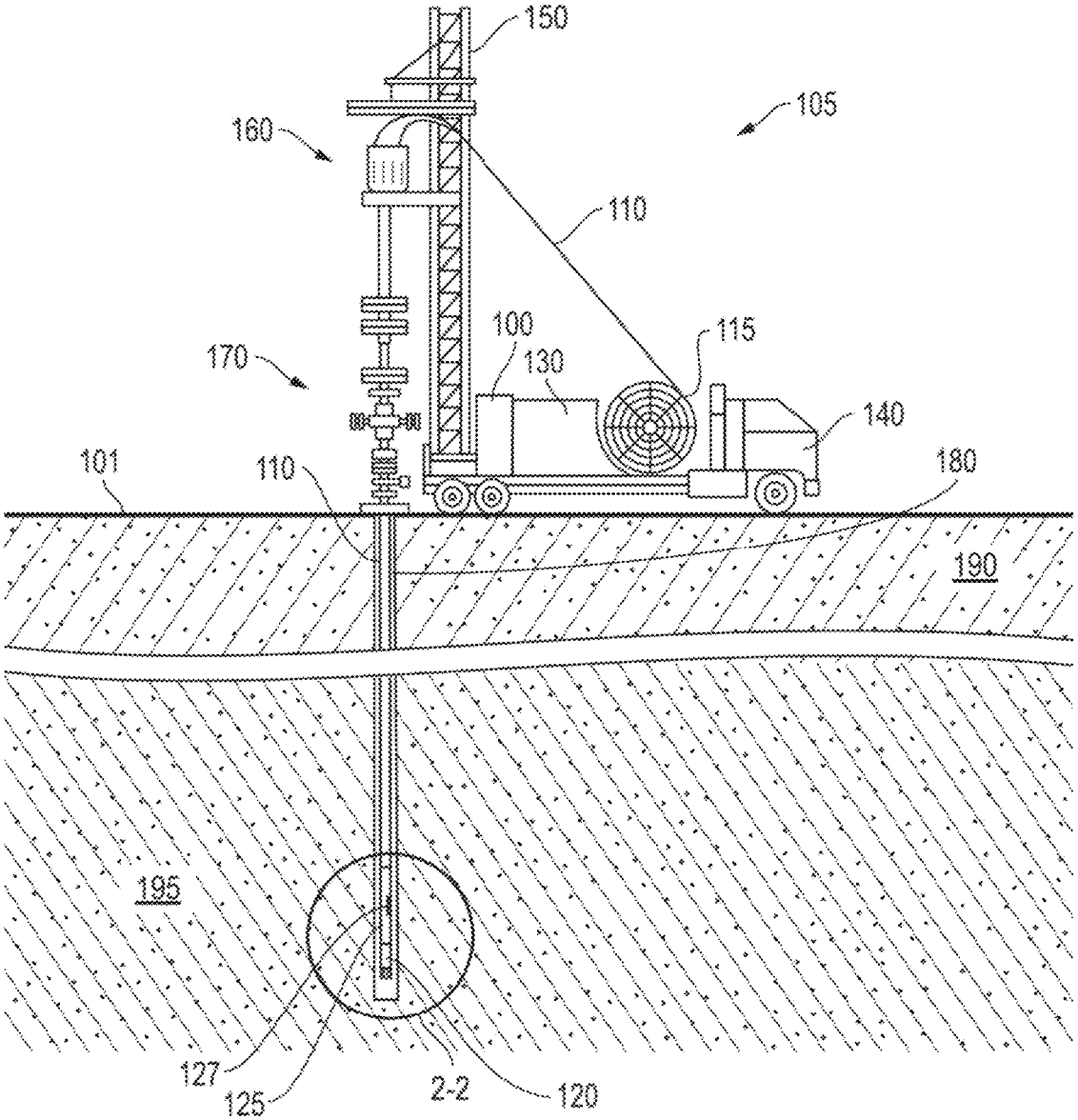
FIG. 1 is an overview depiction of an oilfield with a well accommodating a dynamic load resistant drilling system.

Referring specifically now to FIG. 1, an overview depiction of an oilfield 105 is shown with a wellbore 180 accommodating components of a dynamic load resistant drilling system. Specifically, for the embodiment shown, a conveyance in the form of coiled tubing 110 is shown as it is used to drill the wellbore 180 with a drilling device 120. A borehole assembly (BHA) 125 accommodating an electronics package 127 and other potentially dynamic load sensitive components is illustrated in the vicinity of the drilling device 120. For example, much of the operation of the drilling device 120 may be directed by or routed through the BHA 125.

In the embodiment shown, a control unit 100 is located with other equipment at an oilfield surface 101. However, the unit 100 may be positioned more remotely or even downhole, for example, incorporated into the BHA 125.

Regardless, the control unit 100 is configured to communicate with the electronics package 127 or other components of the BHA 127 as well as with other surface equipment directing drilling operations as detailed further below (e.g. a coiled tubing injector 160 or a drive assembly 130). In this way, dynamic load may be monitored and either the load on the conveyance or the rpm of the drilling device may be adjusted in a real-time and/or automated manner. For example, in the case of coiled tubing drilling, the rate of gas pumping or fluid through the coiled tubing 110 may be increased to increase rpm of the drilling device 120 or to reduce flow-rate to reduce the rpm.

Continuing with reference to FIG. 1, the surface equipment includes a mobile coiled tubing truck 140 carrying a reel 115 of coiled tubing 110 that is supported by a mobile rig 150 and forcibly driven through a pressure control system 170 by a conventional gooseneck injector 160 as described above. In this way, the coiled tubing 110, BHA 125 and drilling device 120 may be driven several thousand feet through the wellbore 180 traversing multiple formation layers 190, 195. Of course, the load provided and the drilling device 120 serve to form the borehole 180 during the advancement. Thus, as noted, a considerable amount of dynamic load in the form of shock and/or vibration may ensue.

Figure 2:
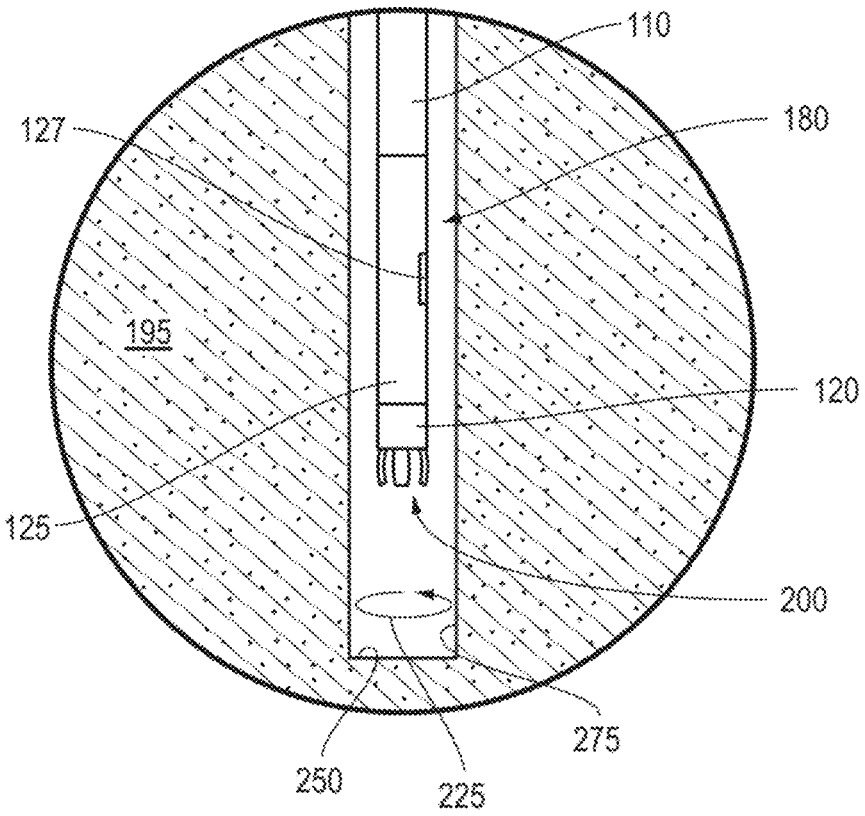
FIG. 2 is an enlarged view of a drilling device and an electronics package assembly taken from 2-2 of FIG. 1.

Referring now to FIG. 2, an enlarged view of a drilling device 120 is shown along with the BHA 125 and an electronics package assembly 127 taken from 2-2 of FIG. 1. The drilling device 120 includes a bit 200 that rotates (see arrow 225). Specifically, the bit 200 drills the wellbore 180 through the formation 195 by continuously interfacing a wellbore lower surface 250 and sidewalls 275 during the rotation. Even the operation of the motor driving the bit 200 may propagate a degree of shock and vibration on its own. Thus, the noted dynamic load is prone to develop. However, the control unit 100 and modes of operation may help to keep vibration and shock to a minimum for safeguarding of the electronics package 127 and other more sensitive assembly components (see FIG. 1).

Figure 3:
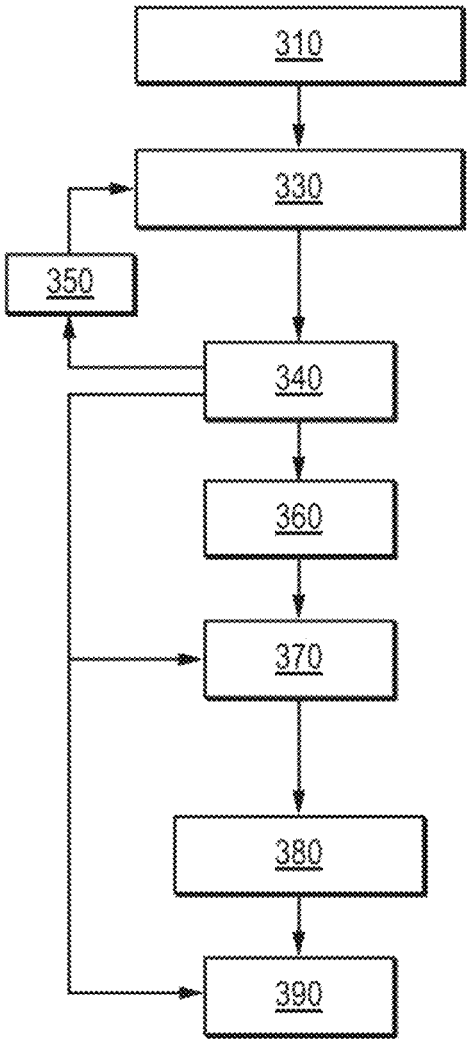
FIG. 3 is a flow diagram illustrating a technique for gathering historical dynamic load information.

Referring now to FIG. 3, a flow diagram illustrating a technique for drilling and gathering historical dynamic load information for subsequent applications is illustrated. More specifically, the diagram illustrates a workflow with predetermined vibration limits that may be utilized to guide drilling operations to safeguard well drilling components such as the noted electronics package 127. Once more, the practical impacts of following such workflows may be maintained as a reference log for aiding in developing parameters for the outset of drilling operations as well as dynamic adjustments during operations. Indeed, as described below, these parameters may be tested by way of simulation in advance of drilling operations.

Continuing with reference to FIG. 3, drilling may commence with a predetermined load and rpm with vibrations being measured at the outset in block 310. This may include measurements of axial, lateral and/or torsional vibration. Initial adjustments may be made based on a variety of predetermined thresholds in block 330. For example, where large weight on bit (WOB) fluctuations or topdrive shaking occurs from an axial standpoint, the WOB may be increased with a commensurate decrease in bit rpm. In another example, where an increase in mean surface torque or a reduction in rate of penetration (ROP) occurs from a lateral standpoint, the adjustment to a decrease in rpm with a commensurate increase in WOB may ensue. Further, from a torsional standpoint, detection of topdrive stalling or an increase in surface torque variations may suggest that a decrease in WOB and an increase in rpm may be in order.

Where adjustments are made as indicated at block 330, vibrational thresholds may again be detected at block 340. Where the adjustments have resulted in vibrational thresholds no longer being exceeded, drilling may ensure (see block 360). However, where the thresholds remain exceeded, further adjustment may take place (see block 350) and the process repeated. Of course, the possibility remains that, even where vibrational thresholds are no longer exceeded and drilling has resumed, subsequent vibrational thresholds may again be exceeded (see block 370). Thus, at block 380, adjustments may once again be implemented and drilling once again resumed at block 390.

The above workflow of FIG. 3 may serve as a proper guide for adjusting well drilling parameters and also, with an acquired record over time, may supply historical data logs for future or ongoing operations. However, determining initial thresholds for the workflow as well as dynamic adjustments may also be undertaken as detailed below with more specific reference to FIGS. 4 and 5.

Figure 4:
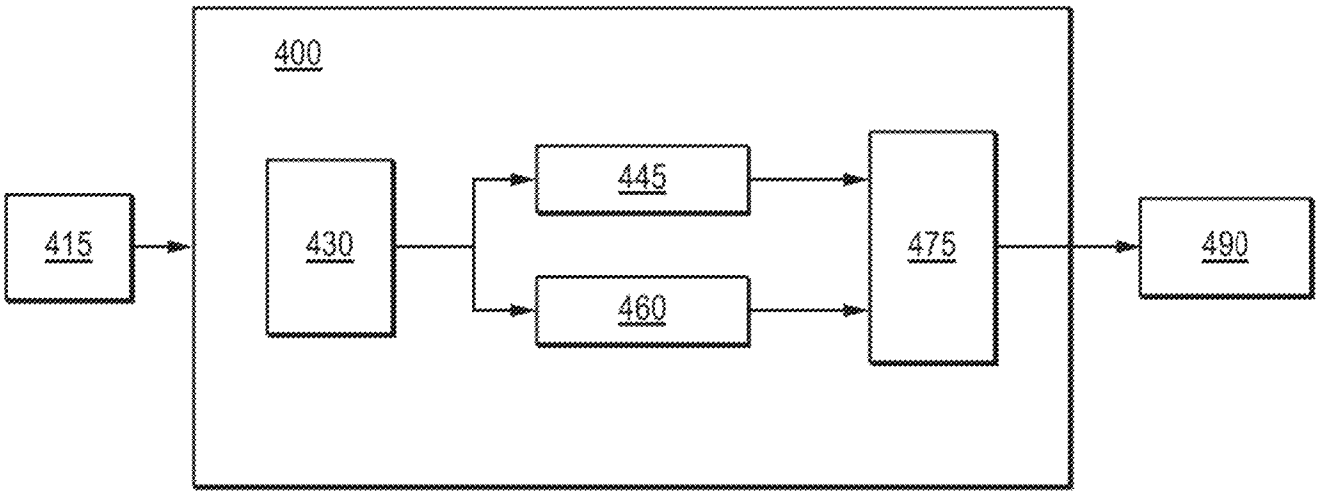
FIG. 4 is a flow diagram illustrating a technique to establishing initial parameters for drilling operations.

Referring now to FIG. 4, a flow diagram illustrating a technique to establishing initial parameters for drilling operations is shown. That is, with historical information and operator experience from prior runs of workflows as described with reference to FIG. 3, different sets of input job parameters 415 may be available. For example, the type of conveyance, the amount of weight or load applied to the bit, rpm of the bit and other factors may be presumed and tested in a simulated manner as described below. Even factors such as the particular component arrangement of the BHA 125 of FIG. 1 may be considered for each simulation and differing scores that may be obtained at 490 as described below. Prior to drilling, the engine may serve as an optimizer based on available job parameters. Further, once drilling commences, the engine may continue to run, providing a dynamic phase diagram for ongoing, real-time adjustment as also described further below with reference to FIG. 5.

As indicated, the diagram of FIG. 4 represents a pre-job model for predicting the mechanical behavior based on a set of input parameters 415 for use at the start of drilling operations. Thus, with a given set of input parameters at 415, a core model 400 may be applied to develop an overall planning score at 490. More specifically, the core model 400 includes a simulator 430 that is a mechanical model to simulate different combinations of controllable variables. The simulation results may be fed to both a vibration classification module 445 and a feature learning module 460. The vibration classification module 445 may feed phase diagram information to a job evaluator 475 whereas the feature learning module 460 may feed learned features for state identification to the evaluator 475. Ultimately, the evaluator 475 may process the fed information to provide a planning score 490 as noted above.

The simulator 430 may be a dynamic model that simulates time-dependent behavior of the system or a static computation engine. For a dynamic model, the conveyance and other downhole equipment may be discretized into segments and modeled using Newton's laws of motion (e.g. mass multiplied by acceleration to provide forces in a generalized form). For a static model, a stiffness matrix may be assembled for the system where eigen values determine vibration features.

The vibration classifier 445 may be used to provide a phase diagram from the mechanical model outputs from the simulator 430 as described further below. For example, the classifier 445 may determine whether or not the system will be on resonance. The feature learner 460 may be used to classify the simulation results. For example, the learner 460 may obtain the simulation results to perform self-clustering and find the best way to extract features that help localize the system on the phase diagram. Utilizing these features, the system may locate itself in real-time on the phase diagram of FIG. 5 and help improve the classifier 445 in an ongoing manner as described below.

Ultimately, the job evaluator 475 is employed to provide a planning score 490. The score may provide an ultimate evaluation of the parameters initially provided at 415. Further, it may generally be based on the size of a safe operating envelope with an acceptable vibration level in addition to the ability of the system to locate itself on the phase diagram of FIG. 5 in light of the feature learner 460.

Figure 5:
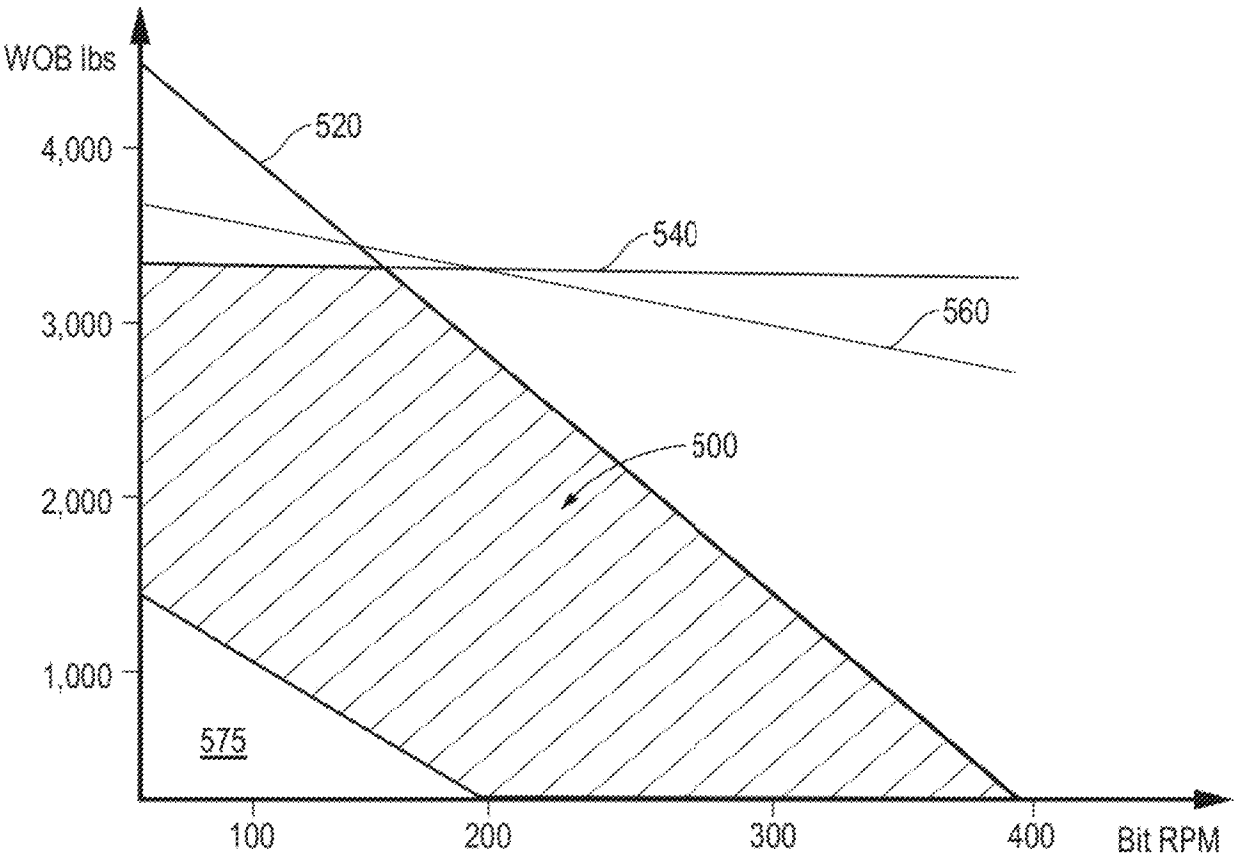
FIG. 5 is a phase diagram illustrating a dynamically adjustable zone of weight on bit versus rpm based on real-time information acquired after initiation of drilling operations.

Referring now to FIG. 5, a phase diagram is shown that illustrates a dynamically adjustable acceptance zone 500 of weight on bit (WOB) versus rpm based on real-time information acquired after initiation of drilling operations. Of course, the depiction is a static illustration and may also be thought of presenting an initial acceptance zone 500 implemented at the outset of drilling operations as determined by scores 490 obtained from the engine of FIG. 4.

The illustrated zone 500 of FIG. 5 is only exemplary with limits such as 380 rpm for the bit shown at the x-axis and WOB being limited to about 3,250 lbs indicated at the y-axis. The remainder of the zone 500 is defined primarily by dynamic load plots of shock and vibration (e.g. resonance 520 and stick-slip 540). Additionally, notice that another plot of buckling 560 is presented which may be pertinent in the case of coiled tubing drilling. In the instance illustrated, this plot 560 does not define the acceptance zone 500 for the snapshot moment in time illustrated. However, recall that the phase diagram is dynamic with changes occurring moment to moment as the drilling operations proceed. Thus, relative to the y-axis, the buckling plot 560 might lower or the stick-slip plot 540 might raise (in addition to movement of the resonance plot 520). This would lead to a dynamically changing acceptance zone 500 with limits being alternatingly set by different plots (e.g. a switching of 540 and 560 in defining the zone 500). Along these lines, it is also worth noting that, in addition to constituting a given snapshot in time, for sake of illustrating the described concepts, the boundaries (e.g. 520, 540, 560) are depicted in a linear manner. However, the actual boundaries may be non-linear and depend on a wide variety of factors that play into a multitude of possible drilling configurations.

Continuing with reference to FIG. 5, a low rate of penetration (ROP) region 575 is also illustrated to further define the acceptance zone 500. While not presenting dynamic shock issues to drilling operations in this region 575, the operator may opt to exclude the region from the acceptance zone 500 anyway. For example, as a practical matter, anywhere that the bit rpm is below about 200 and the WOB is below about 1,500 lbs., the rate of penetration may simply be too low to be acceptable for drilling operations in the example shown. Of course, this is only exemplary but it is also understandable that some minimum level of ROP might be expected in order for drilling operations to commence and continue in a productive and profitable manner.

The above-described simulation of FIG. 4 may be used to initiate operations with score-based parameters at the outset of drilling. This is represented in FIG. 5 as a snapshot phase diagram which may present initially as shown and dynamically adjusted as operations continue, for example, with the acceptable zone 500 morphing and changing in definition over time. That is, real-time, dynamic load information may be acquired as drilling commences and continues as described above. This means that with a shifting morphology of the acceptable zone 500, the control unit 100 of FIG. 1 may be employed to adjust drilling parameters in real-time based on the changing acceptable zone 500. Recall that some of the dynamic load information available may be from downhole equipment such as the BHA 125 of FIGS. 1 and 2. Other information may be available based on the directed operations (e.g. the rpm of drilling device 120 at any given moment). Thus, the control unit 100 of FIG. 1 may make real-time adjustments to the directed drilling operations to ensure that the acceptable zone 500 is maintained throughout.

In one embodiment, a fallback provision may be initiated to move to a model-free mode. For example, consider a circumstance in which actual practice implementation of modeled rpm and WOB that should maintain operations within the acceptable zone 500 of FIG. 5 but in actuality fail to do so. In one embodiment, where this occurs, a default may take place to a mode of operations as described with respect to FIG. 3. That is, where the implementation of the modeling and real-time monitoring of the optimizer of FIG. 4 fails to result in maintenance of dynamic load within the zone 500 of FIG. 5 for a predetermined period, perhaps 10 minutes, the control unit of FIG. 1 may adjust drilling operations to a workflow as described with reference to FIG. 3. Thus, at a minimum, a return to acceptable parameters may be initiated along with dynamic load data collection for use in future drilling operations.

Figure 6:
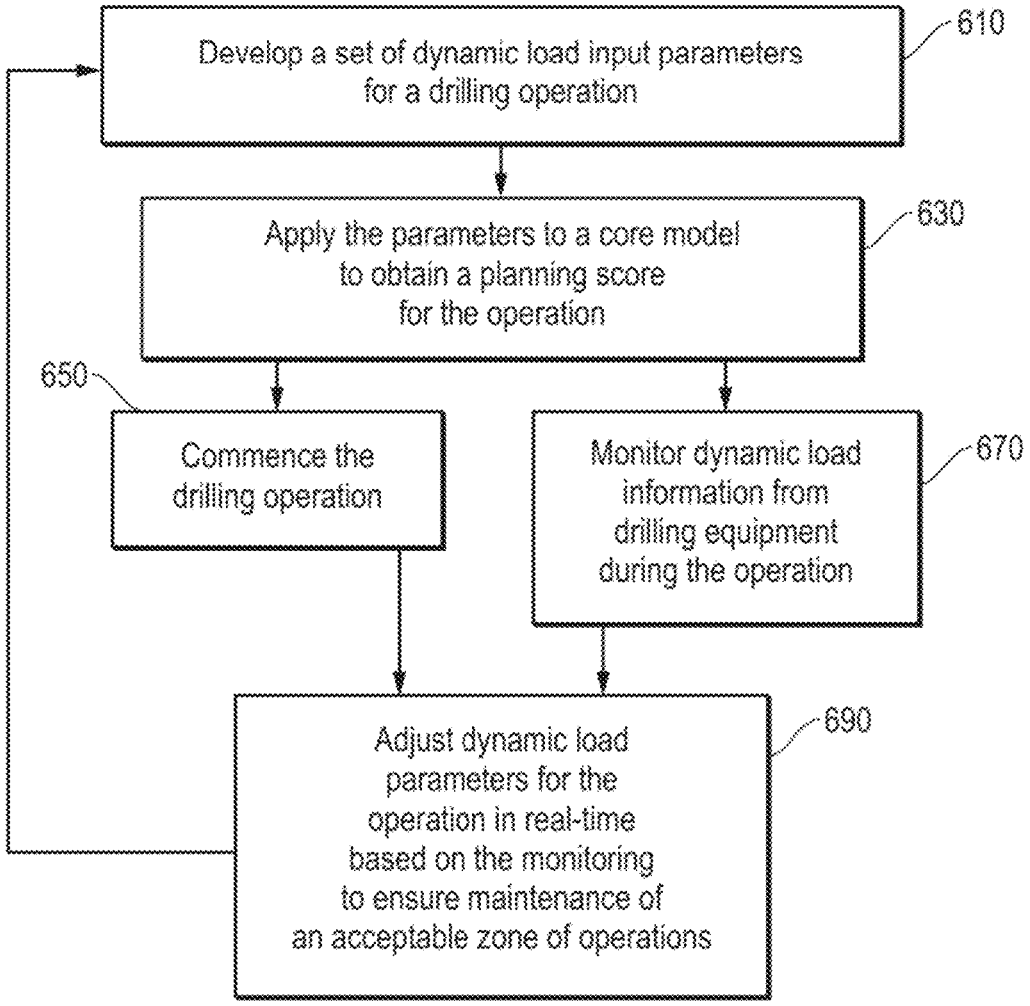
FIG. 6 is a flow-chart summarizing an embodiment of utilizing a dynamic load resistant drilling system.

Referring now to FIG. 6, a flow-chart summarizing an embodiment of utilizing a dynamic load resistant drilling system is shown. The chart notes that a core model at 630 may be used to obtain a planning score for drilling operations that is based on expected dynamic loads brought on by the operations. Indeed, at the outset, dynamic load input parameters are developed as indicated at 610 and fed into the core model at 630 for sake of simulating various acceptable outcomes such that an acceptance zone may be developed (e.g. see FIG. 5 herein).

Of course, once the simulations have been developed, drilling operations may actually commence as indicated at 650. This means that real-time monitoring of dynamic load in practice is available as indicated at 670. Further, where necessary, feedback and adjustment to the parameters may take place during the drilling operations as indicated at 690 to help ensure maintaining dynamic loads within the noted acceptance zone. Once more, when a predetermined amount of time has elapsed with parameters keeping outside of the acceptance zone, input parameters may be re-developed by default (see arrow back to 610).

Embodiments of a dynamic load resistant drilling system are detailed herein. The system operates in an automated manner that avoids the requirement of manual operator intervention for sake of adjusting rpm or weight on a bit to reduce shock or vibration. This is particularly beneficial for the protection of dynamic load sensitive components, for example at an electronics package of a BHA or even to avoid mechanical issues at connections or joints of the BHA. The system facilitates such real-time and automated adjustments to help ensure that operations remain in a predetermined acceptable zone of dynamic load during drilling without sole reliance on operator maneuvering.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Regardless, the foregoing description should not be read as pertaining only to the precise structures described and shown in the accompanying drawings, but rather should be read as consistent with and as support for the following claims, which are to have their fullest and fairest scope.

We claim:

1. A system for use at an oilfield, the system comprising:

a conveyance;

a drilling device coupled to the conveyance, wherein the drilling device is configured to propagate a dynamic load during drilling of a wellbore at the oilfield;

an electronics package assembly coupled to the conveyance and the drilling device; and a controller communicatively coupled to the electronics package assembly, wherein the control unit controller is configured to:

acquire dynamic load information from one of the electronics package assembly and surface equipment directing the drilling of the wellbore from a surface of the oilfield;

compare the acquired dynamic load information to a threshold dynamic zone bounded by a plurality of boundaries to obtain a comparison, wherein at least one boundary of the plurality of boundaries varies over time during the drilling of the wellbore;

adjust, while operating the controller in a first control mode, a load on the conveyance, a rotational speed of the drilling device, or both in real-time based on the comparison; and in response to the acquired dynamic load information falling outside the threshold dynamic zone for a threshold period of time:

cease operating the controller in the first control mode; and regulate, while operating the controller in a second control mode, the load on the conveyance, the rotational speed of the drilling device, or both to be within one or more predetermined threshold ranges.

2. The system of claim 1, wherein the conveyance comprises:

a coiled tubing; and a drill pipe.

3. The system of claim 1, wherein the electronics package assembly is disposed in a bottom hole assembly coupled to the drilling device.

4. The system of claim 1, wherein the controller comprises a processor configured to determine a planning score based on one or more dynamic load input parameters corresponding to the load on the conveyance, the rotational speed of the drilling device, or both.

5. The system of claim 4, wherein the processor receives the one or more dynamic load input parameters from a historical log of one or more prior drilling operations.

6. The system of claim 4, wherein the processor is configured to determine the planning score based on running a simulator in a form of having a mechanical model to simulate a plurality of combinations of controllable variables.

7. The system of claim 1, wherein the conveyance comprises a tubular conveyance.

8. The system of claim 1, wherein the controller is configured to maintain the load on the conveyance and the rotational speed of the drilling device within the threshold dynamic zone in response to the at least one boundary varying over time.

9. The system of claim 1, wherein the threshold dynamic zone is a two-dimensional zone, and the threshold dynamic zone is a contiguous zone.

10. The system of claim 1, wherein each boundary of the plurality of boundaries is a function of the load on the conveyance, the rotational speed of the drilling device, or both.

11. The system of claim 1, wherein the plurality of boundaries comprises:

a resonance threshold;

a bit stick-slip threshold; and a coiled tubing buckling threshold.

12. The system of claim 1, wherein:

the controller comprises a processor configured to determine a planning score based on one or more dynamic load input parameters corresponding to the load on the conveyance, the rotational speed of the drilling device, or both;

the processor receives the one or more dynamic load input parameters from a historical log of one or more prior drilling operations;

the processor is configured to determine the planning score based on running a simulator having a mechanical model to simulate a plurality of combinations of controllable variables;

the conveyance comprises a tubular conveyance;

the controller is configured to maintain the load on the conveyance and the rotational speed of the drilling device within the threshold dynamic zone in response to the at least one boundary varying over time; and the threshold dynamic zone is a two-dimensional zone, and the threshold dynamic zone is a contiguous zone.

13. A method of drilling a wellbore at an oilfield, the method comprising:

determining a set of dynamic load input parameters for a drilling operation;

determining a planning score corresponding to the set of dynamic load input parameters;

commencing the drilling operation with the set of dynamic load input parameters based on the planning score;

monitoring dynamic load information from drilling equipment during the drilling operation;

comparing the dynamic load information to a threshold dynamic zone bounded by a plurality of boundaries to obtain a comparison, wherein at least one boundary of the plurality of boundaries varies over time during the drilling operation;

adjusting, via a controller operating in a first control mode, one or more dynamic load parameters corresponding to the drilling operation in real-time based on the comparison; and in response to the dynamic load information falling outside the threshold dynamic zone for a threshold period of time:

cease operating the controller in the first control mode; and regulating, via the controller operating in a second control mode, the one or more dynamic load parameters to be within one or more predetermined threshold ranges.

14. The method of claim 13, wherein the adjusting of the one or more dynamic load parameters comprises:

adjusting a weight on bit value corresponding to a drilling device;

adjusting a rotational speed of the drilling device; or any combination thereof.

15. The method of claim 13, wherein the one or more predetermined threshold ranges comprise:

a resonance threshold;

a bit stick-slip threshold;

a coiled tubing buckling threshold; or any combination thereof.

16. The method of claim 13, wherein the threshold dynamic zone is partially based on a lower limit for a rate of penetration of the drilling operation.

17. The method of claim 13, wherein the adjusting of the one or more dynamic load parameters comprises:

applying a predetermined workflow to an additional drilling operation, wherein the predetermined workflow comprises varying a weight on bit value of a drilling device, a rotational speed of the drilling device, or both;

monitoring a dynamic load during the additional drilling operation; and developing a historical log of drilling input parameters used in the additional drilling operation.

18. A method, comprising:

determining a weight on bit value and a rotational velocity for a drilling device employed in drilling a wellbore at an oilfield;

drilling the wellbore based on the weight on bit value and the rotational velocity;

monitoring a dynamic load during the drilling of the wellbore;

comparing the dynamic load to a threshold dynamic zone bounded by a plurality of boundaries to obtain a comparison, wherein at least one boundary of the plurality of boundaries varies over time during the drilling;

adjusting, via a controller operating in a first control mode, the weight on bit value, the rotational velocity, or both based on the comparison; and in response to the dynamic load falling outside the threshold dynamic zone for a threshold period of time:

cease operating the controller in the first control mode; and regulating, while operating the controller in a second control mode, the weight on bit value, the rotational velocity, or both to be within one or more predetermined threshold ranges.

19. The method of claim 18, wherein the monitoring of the dynamic load comprises:

measuring axial load;

measuring lateral load;

measuring torsional vibration; or any combination thereof.

20. The method of claim 18, wherein the adjusting is responsive to;

a fluctuation in the weight on bit value;

topdrive shaking;

an increase in mean surface torque;

topdrive stalling;

an increase in one or more surface torque variations; or any combination thereof.

* * * * *